United States Patent [19]

Moore

[11] 4,432,553

[45] Feb. 21, 1984

[54] COWBOY RODEO CONTEST GAME

[76] Inventor: Hazel M. Moore, 148 Kellie La., Auburn, Calif. 95603

[21] Appl. No.: 332,729

[22] Filed: Dec. 21, 1981

[51] Int. Cl.[3] ..... A63F 3/00

[52] U.S. Cl. ..... 273/244

[58] Field of Search ..... 273/236, 243, 249, 248, 273/244

[56] References Cited

U.S. PATENT DOCUMENTS

| | | | |
|---|---|---|---|
| 470,765 | 3/1892 | McArthur | 273/249 |
| 1,240,756 | 9/1917 | Moore | 273/243 |
| 1,615,927 | 2/1927 | Atkinson | 273/248 X |
| 1,799,843 | 4/1931 | Bradford et al. | 273/236 |
| 2,442,194 | 5/1948 | Briscoe | 273/249 |
| 2,611,616 | 9/1952 | Kloss | 273/249 X |
| 3,030,112 | 4/1962 | Scharp | 273/248 |
| 3,698,717 | 10/1972 | Canizares | 273/244 |
| 4,046,381 | 9/1977 | Comeaux | 273/249 |
| 4,248,437 | 2/1981 | Lemberger et al. | 273/243 |

FOREIGN PATENT DOCUMENTS

| | | | |
|---|---|---|---|
| 907939 | 3/1946 | France | 273/248 |

*Primary Examiner*—Richard C. Pinkham
*Assistant Examiner*—Scott Brown
*Attorney, Agent, or Firm*—Leonard Bloom

[57] ABSTRACT

A game to be played by preferably two, three, four, five or six players using a circular game board divided into six sections, each section representing a different event in a rodeo contest. Each of the six sections is a different color and has six pegs of the same color associated therewith. Each player chooses a color and starts with the pegs associated therewith. The events are numbered one through six each corresponding to the numbers on a die. Each player in turn rolls five dice simultaneously and three of a kind must be obtained in order to advance a peg in the numbered event that corresponds to the triple obtained by rolling the dice. The pegs are advanced circumferentially in peg holes corresponding to the event number. After rolling four triples in any single event the player is allowed to advance the peg to the first, second or third place position in the award area of the board corresponding to the specific event. Each place in each event is assigned a monetary valve and the overall winner is decided by adding the overall winnings.

6 Claims, 1 Drawing Figure

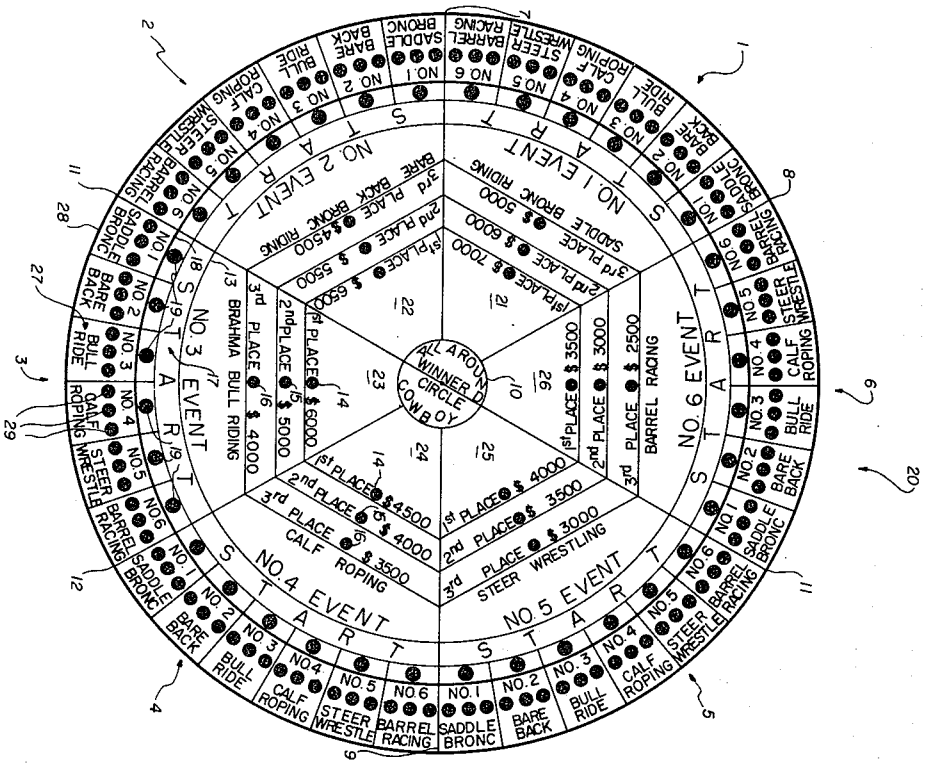

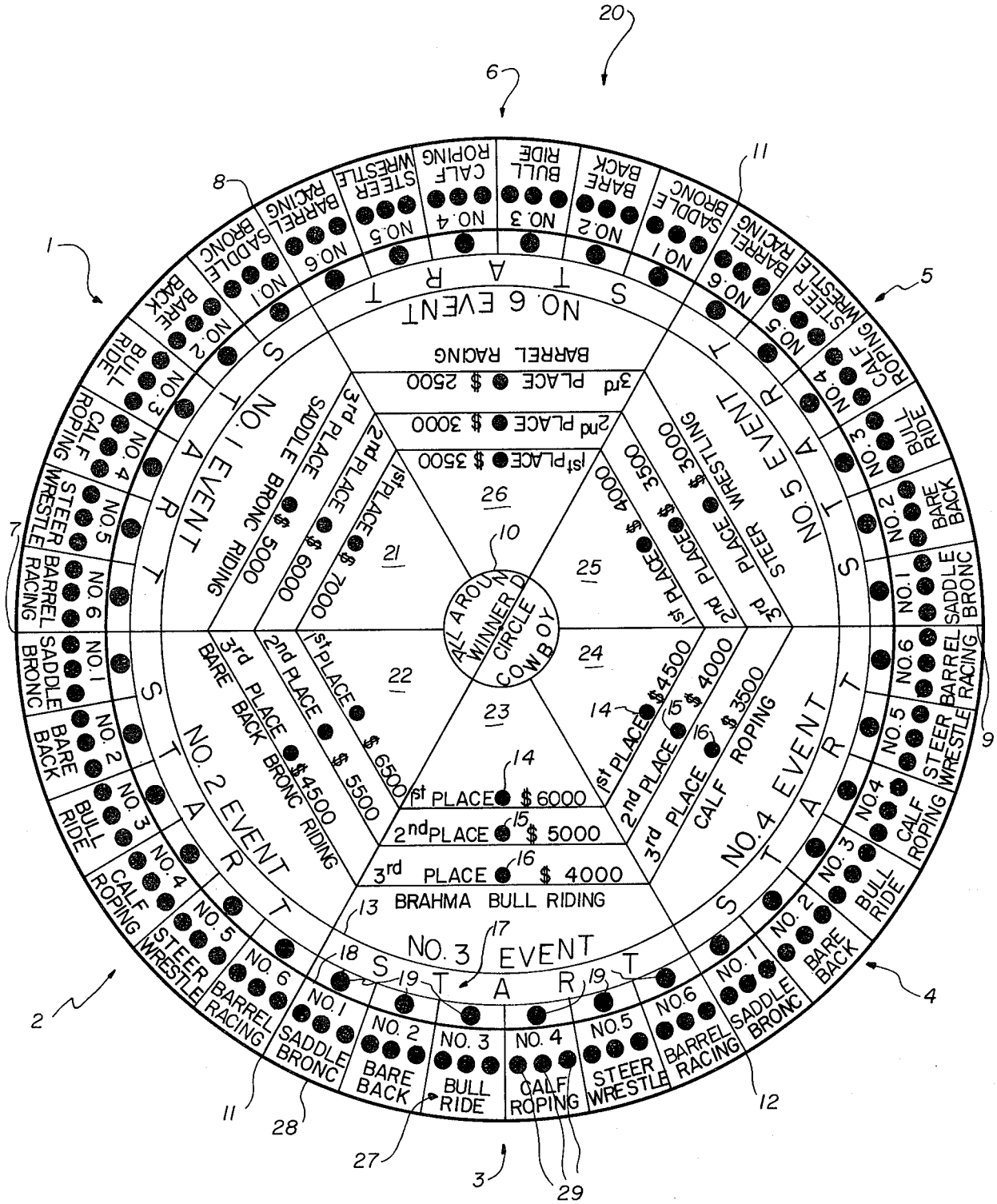
NO. 1 EVENT START
NO. 2 EVENT START
NO. 3 EVENT START
NO. 4 EVENT START
NO. 5 EVENT START
NO. 6 EVENT START
ALL AROUND WINNER CIRCLE COWBOY
1st PLACE $ 6000
2nd PLACE $ 5000
3rd PLACE $ 4000
BRAHMA BULL RIDING
1st PLACE $ 4500
2nd PLACE $ 4000
3rd PLACE $ 3500
CALF ROPING
1st PLACE $ 3500
2nd PLACE $ 3000
3rd PLACE $ 2500
BARREL RACING
1st PLACE $ 6500
2nd PLACE $ 5500
3rd PLACE $ 4500
BARE BACK BRONC RIDING
1st PLACE $ 6000
2nd PLACE $ 5000
3rd PLACE $ 4000
SADDLE BRONC RIDING
1st PLACE $ 4000
2nd PLACE $ 3500
3rd PLACE $ 3000
STEER WRESTLING
NO. 1 SADDLE BRONC
NO. 2 BARE BACK
NO. 3 BULL RIDE
NO. 4 CALF ROPING
NO. 5 STEER WRESTLE
NO. 6 BARREL RACING

COWBOY RODEO CONTEST GAME

BACKGROUND OF THE INVENTION

The present invention relates generally to game boards and particularly to a game simulating the events of a rodeo.

Many game boards exist which simulate real life events such as sports, business and romance.

The following patents reflect the state of the art of which applicant is aware in so far as these patents appear to be germane to the patent process:

U.S. Pat. No. 3,698,717, Canizares

U.S. Pat. No. 4,010,957, Tricoli

U.S. Pat. No. 4,121,823, McBride

None of the references uncovered by the applicant simulate the events of a rodeo or employs the process used in the instant invention to distinguish the overall winner.

OBJECTS AND SUMMARY OF THE INVENTION

It is therefore the primary object of the present invention to provide a novel game board which simulates the events of a rodeo contest wherein the participants compete in the several events to determine the all around cowboy winner.

This object is achieved by the provision of a circular game board, divided into six equal radial sections, and a circular central zone to receive an all around winner. Each color coded section is further divided into three areas, each of which has a series of holes to receive a plurality playing pegs. Starting from the center, the first area in each section is an awards area which represents a single event in the rodeo contest and is provided with three holes, one each for first, second and third place. Any player may peg in this area if appropriate. The second area in the section is a first playing pathway which is provided with preferably six holes to receive the six color coded playing pegs in their original or start position. The third area of each section defines a second playing pathway and is divided into six segments one representing each awards area. Each segment has three holes to receive playing pegs as the player advances through the event in preparation to enter the awards area. A player rolls five dice attempting to achieve three of a kind, which allows the player to advance from the starting position to the first hole in the segment of the second passageway which corresponds to the number of the event and the triplicate number on the dice. For example, a player rolling three twos advances his peg from the start position to a first peg hole in segment number 2 corresponding to the second event which is bare back. After a player has rolled three triples of the same numerical value, he may advance to the awards area corresponding to the number of the event upon rolling a fourth triple. The player places his peg in the highest position yet unoccupied. When all of the peg holes in all the award areas are filled by the various players, which can range preferably from two to six, then the cash amounts associated with each awards place are added up and the player with the highest score is declared the all around cowboy winner.

BRIEF DESCRIPTION OF THE DRAWING

The drawing FIGURE is a top view of the game board.

BRIEF DESCRIPTION OF THE PREFERRED EMBODIMENT

Referring now to the drawing in detail wherein like reference numerals represent like parts throughout the drawing, reference numeral 10 refers to the all around cowboy winner circle which represents the object of the game.

The circular playing board, generally referred to by reference numeral 20, is divided into two semi-circles by a diameter line 11 and further divided into six equal radial sections, generally referred to by reference numeral 1, 2, 3, 4, 5 and 6, by radian lines 7, 8, 9 and 12. For example, section 3 at the bottom is defined on either side by the diameter line 11, and the radian 12. Each section is substantially similar to all the other sections, except that the awards areas 21, 22, 23, 24, 25 and 26 have different indicia to represent six different rodeo contest events: SADDLE BRONC RIDING, BARE BACK BRONC RIDING, BRAHMA BULL RIDING, CALF ROPING, STEER WRESTLING AND BARREL RACING.

The following discussion will focus on section three as representative of all the other sections.

The substantially pie-shaped awards area 23 is defined on either side by the diameter line 11 and the radian 12 and on the bottom by peripheral line 13, appearing just below the words "NO. 3 EVENT". This area has three radially disposed peg holes 14, 15 and 16 which correspond to first, second and third places, each of which is given a, monetary value. This award area 23 represents the third event which is brama bull riding.

The next important area in section 3 is the first playing pathway, generally referred to by reference numeral 17, and defined inwardly by an arcuate peripheral line 13, outwardly by a parellel arcuate peripheral line 18, and on either side by diameter line 11 and radian 12. The first playing pathway 17 has the word START inside it and is divided into six segments each of which contains a peg hole 19. At the start of the game, each of these peg holes 19 receives a peg of the same color as the section 3.

The third important area of section 3 is the second playing pathway, generally referred to by reference numeral 27, and defined inwardly and outwardly by arcuate and parallel peripheral lines 18 and 28 respectively, and defined on either side by diameter line 11 and radian 12. The second playing path 27 is preferably divided into six equal segments numbered 1 through 6 to correspond to one of the six rodeo events. Each segment has three peripherally spaced peg holes 29 to receive the playing pegs.

In use and operation, a player chooses a color and takes the six pegs of that color and places them in the peg holes 19 in the start section of the board of same color. Thus, each player has six pegs in the peg holes 19 under the word START in the first playing path 17. Preferably from two to six players can be accommodated in a single game.

Next, each player rolls a die and the highest goes first. The first player takes all five dice and rolls them simultaneously. Three of the five dice must come up with the same numerical value in order to proceed further, and if this is not achieved then the dice are passed to the next player in turn. Three of a kind entitles the player to remove a peg from the first playing path 17 and place it in the first peg hole 29 in the segment of the second playing path 27 that corresponds to the numerical value of the triplicate roll. For example, if a player rolls three fours, he removes the peg in the first playing path 17 directly above the segment number 4 of the second playing path 27 and places it in the peg hole 29 furthest to the left in segment number 4 marked CALF ROPING. Each time that player rolls a triplicate four he advances the peg from left to right until he reaches the third peg hole 29 in segment number 4. Thus, after rolling triple fours three times the peg has advanced from peg hole 19 in the first playing path 17 to the furthest righthand peg hole 29 in segment number 4. The next time a triple four is rolled by that player the peg is advanced from the peg hole 29 in segment number 4 to the appropriate awards area 24 which corresponds to the calf roping event number 4. That player places the peg in the highest available peg hole 14, 15 or 16 that is unoccupied, thereby being awarded the monetary value associated with that particular peg hole in that particular awards area. In the present example, if there were no other pegs in awards area number 24, the instant player would place his or her peg in the peg hole 14, corresponding to first place in awards area 24 and be awarded first place and $4,500.00.

A player continues to roll until he no longer achieves a triplicate numerical value on the dice, and he passes them on to the next player in turn. If on the second roll a player obtains a different triplicate value, he proceeds exactly as he did in the first instance, moving the peg associated with the segment that corresponds to the numerical value of his triplicate. The game proceeds in this fashion until all of the award areas are filled or until the players have no more pegs and then the total winnings for each player is added up and the all around cowboy winner is determined.

In an alternate embodiment, when more than three dice are the same numerical value the player gets to move the peg an extra position for each of the two remaining die that are same numerical value. For example, if a player rolls five fours, he moves the appropriate peg to the furthest right peg hole 29 in segment number 4 instead of to the furthest left peg hole 29, thereby gaining two extra positions.

If a player rolls a triple and already has a peg in the corresponding awards area then he must forfeit another peg, which is removed from the board and becomes inactive. If a player rolls a triple and all the corresponding awards area is filled by other players pegs then his peg designated for that awards area is removed from the board and becomes inactive. If an awards area becomes completely filled in the first, second and third places, then the players whose pegs are in that section sits out until all of the other players have finished.

What is claimed is:

1. A game simulative of plural rodeo events comprising in combination:

a board radially divided into equal N sections, first and second playing paths peripherally disposed about said board, said first playing path disposed concentrically inward relative to said second playing path and leaving an awards area in each said section corresponding to a specific said rodeo event, a plurality of playing pieces deployable in said paths and said awards area, chance means for directing the deployment of said playing pieces, and a central winner's zone on said board adapted to receive at least one of said playing pieces denoting an overall winner wherein each said awards area includes a means for differentiating performance of a player in said specific rodeo event wherein N holes are provided in each said first playing path section and and N playing pieces are disposed therein at the outset of said game wherein three N holes are provided in each said second playing path section, said first and second playing paths subdivided into N segments having equal number of holes, whereby playing pieces advance from said first playing path to and along said second playing path responsive to said chance means.

2. The device of claim 1 wherein said awards area is provided with N/2 holes for reception therein of a playing piece which advances from said second playing path responsive to said chance means.

3. The device of claim 2 wherein said N segments in said first playing path each correspond to said specific rodeo event correlated to a specific said awards area by indicia.

4. The device of claim 3 wherein said N segments in said second playing path each correspond to said specific rodeo event correlated to a specific said awards area by indicia.

5. The device of claim 4 wherein said chance means comprise N-1 dice.

6. The device of claim 5 wherein in N=6.

* * * * *